United States Patent [19]

Mostert

[11] Patent Number: 4,489,582

[45] Date of Patent: Dec. 25, 1984

[54] METHOD FOR STRAIGHTENING DRAWN ROUND STOCK AND APPARATUS FOR THE PRACTICE OF THE METHOD

[75] Inventor: Johann Mostert, Eupen, Belgium

[73] Assignee: Firma Schumag GmbH, Aachen, Fed. Rep. of Germany

[21] Appl. No.: 473,456

[22] Filed: Mar. 9, 1983

[30] Foreign Application Priority Data

Jul. 17, 1982 [EP] European Pat. Off. ..... 82106454.0

[51] Int. Cl.[3] ..... B21D 3/02; B21D 3/04

[52] U.S. Cl. ..... 72/98; 72/99

[58] Field of Search ..... 72/98, 99, 95, 79, 160, 72/164

[56] References Cited

U.S. PATENT DOCUMENTS

| | | | |
|---|---|---|---|
| 1,936,765 | 11/1933 | Lawson | 72/95 |
| 1,977,223 | 10/1934 | Abramsen | 72/98 |
| 2,936,811 | 5/1960 | Skawden et al. | 72/95 |
| 3,222,906 | 12/1965 | Aurin | 72/98 |
| 3,998,083 | 12/1976 | Dilling | 72/95 |
| 4,057,988 | 11/1977 | Tsukamoto | 72/98 |
| 4,356,715 | 11/1982 | Bock et al. | 72/98 |

FOREIGN PATENT DOCUMENTS

| | | | |
|---|---|---|---|
| 679723 | 4/1930 | France | 72/98 |
| 345997 | 7/1972 | U.S.S.R. | 72/98 |
| 453216 | 12/1974 | U.S.S.R. | 72/98 |

*Primary Examiner*—Lowell A. Larson

*Attorney, Agent, or Firm*—Arthur B. Colvin

[57] ABSTRACT

The invention relates to a method and an apparatus for the straightening of drawn round stock. In conventional straightening methods, the round stock to be straightened is transported through the straightener with the entrance and exit in alignment, being thus straightened. With this procedure, large pieces at the beginning and end of the round stock to be straightened are straightened in an unsatisfactory manner and must therefore often be cut off before further fabrication of the round stock. To remedy this disadvantage it is proposed that for instance the deviation from the straight entry line forcibly obtained in the straightener arc by deflection, is maintained as the exit direction from the arc. To this end each round stock receiving device is oriented or can be oriented behind an exit die at least by its receiving elements in such a way that the round stock leaving the exit die enters such receiving elements or the next die series without appreciable changes of direction.

12 Claims, 2 Drawing Figures

Figure 1:
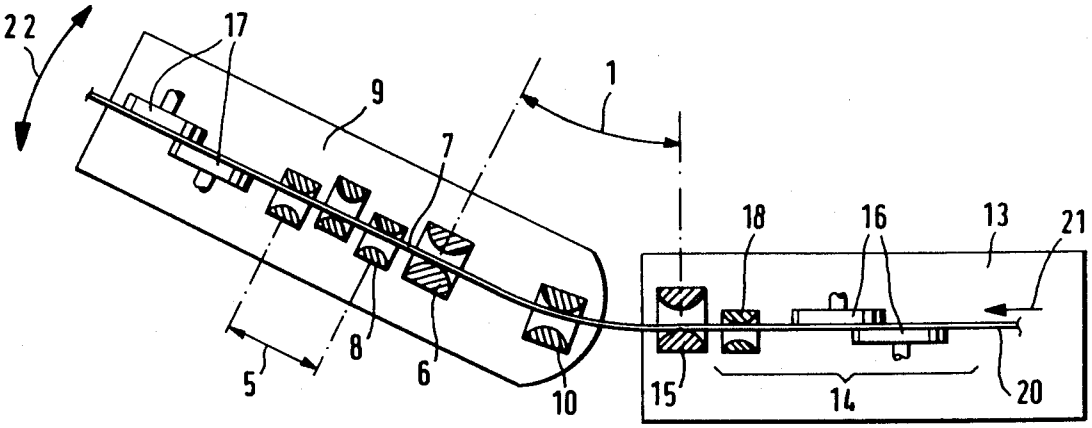

METHOD FOR STRAIGHTENING DRAWN ROUND STOCK AND APPARATUS FOR THE PRACTICE OF THE METHOD

The invention relates to a method for straightening drawn round stock by moving the same forward in lengthwise direction and simultaneous rotating the stock about the longitudinal axis while deflecting the stock from a straight line in a straightening arc containing straightening dies, the yield point of the stock being exceeded.

Further the invention relates to an apparatus for carrying out this method for the straightening of stretched round stock the apparatus having at least one drive device for moving the round stock axially and rotationally and having at least one straightening arc consisting of at least a deflecting die, an exit die and a device for introducing the round stock into the deflecting die, and at least one drive comprising receiving elements for receiving the round stock behind an exit die.

Methods for straightening stretched round stock of the kind described above have become known for example through U.S. Pat. No. 4,356,715 patented Nov. 2, 1982.

From said publications have become known also devices of the above described kind for the practice of such methods.

The technology of straightening stretched round stock has long been known. Latest improvements of the straightening result have been achieved with measures taught in the above named publications. Despite the well known technology of straightening, it has, however, not been possible until now to straighten satisfactorily the beginning and end of a round stock bar or rod to be straightened. The known straightening methods and straightening devices cause at both ends of the bar to be straightened regions of unsatisfactory straightness, so that the user of the straightened bars is often forced to cut off the improperly straightened ends of the bar. Apart from the additional operation required for this, a relatively great loss of material results.

It is therefore an object of the invention to provide a straightening method with which a better straightening result at the ends of the round stock bars to be straightened is obtained.

According to the invention, this problem is solved in a method of the above described kind by the fact that for instance the deviation from the straight entry line forcibly brought about in the straightening arc by deflection is maintained as the exit direction from the arc. Suprisingly this measure has led in actual trial to the occurrence of only very minor straightening defects at the ends of the round stock bars to be straightened, these defects extending over a much shorter zone. The still existing imperfection is so small that very often it is no longer a problem in the further fabrication of these bars, for example by centerless grinding, but is eliminated by the grinding operation. In such cases there is no longer any waste at all of the round stock bars to be straightened.

According to a development of the method, it is proposed that the exit direction of a preceding straightening arc is the entrance direction for a following arc. In known manner it is possible by the use of several successive arcs of different kinds to pick up straightness defects of different ripple ("wave") length and to straighten them. In this connection it is desirable to arrange a following straightening arc in such a way that it can receive the exiting round stock in the exit direction without constraint. It may then be advantageous to provide as following a given arc, a further and preferably lesser arc, the straightening dies of which set closer together, so that in the continuing straightening process shorter and shorter ripples will be picked up. If the successive straightening arcs are disposed according to the teaching of the invention, the defect at the beginning and end of round stock bar or rod can thereby be reduced more and more.

It is a further object of the invention to propose a device with which the method of the invention can be carried out.

According to the invention, this problem is solved in a device of the above described kind in that at least the receiving elements of each round stock receiving device is aligned or alignable behind an exit die of a straightening arc in such a way that the round stock leaving the exit die is gripped without appreciable changes of direction. With such an orientation of the receiving elements it is readily possible to maintain the deflection from the straight entry line forcibly brought about in the straightening arc as the exit direction from the prior arc.

According to a development of the device it is proposed that at least one round stock receiving device is formed by an additional straightening arc, containing a series of straightening dies. This makes it possible, for a succession of straightening arcs, to combine the means for the formation of the arc and the means for the formation of the round stock receiving device, thereby reducing total construction costs.

According to a further form of the device it is proposed that in a succession of several straightening arcs an entry die of each following arc series forms the receiving element. Thus a special receiving element leading to the respective arcs can be saved.

A further form of the device provides that at least the round stock receiving device following the main straightening arc is arranged on a movable base. The round stock receiving device can thereby be readily adapted to different exit directions.

According to a further form of the device it is provided that the exit die of the main straightening arc or zone is arranged on the same movable base. It is thereby achieved that the round stock receiving device automatically adapts itself to a change in exit direction.

A further form of the device provides that also the deflection die of the main arc is arranged on the same movable base. In this manner the most important elements for building the arc and for receiving the exiting round stock are combined on a common machine assembly.

Again, according to a further form of the device, it is proposed to make the base pivotable about an axis perpendicular to the plane of the arc in which the round stock is curved. By changing the curvature of the arc, the device can thereby be adapted to different requirements. At the same time, all elements essential to the invention remain in the relative position required to carry out the method of the invention.

According to still another form of the device it is provided that an aligned or alignable device for receiving the round stock is arranged following at least the last exit die. It thus becomes possible to carry out for example a straightening process of conventional type in several arcs succeeding or superposed on each other in the usual manner, this being then followed in the method according to the invention by the respective device for receiving the round stock in appropriate alignment. It thus becomes possible to supplement existing straightening machines in such a way that the method of the invention can be carried out also with these machines.

According to still another form of the device it is provided that the deflection die at least of the main straightening arc is pivotable about its vertical axis independently of the base. This makes it possible to obtain fine adjustments of the arc curvature by independent pivoting of the deflection die and hence by displacement of the contact point between the die and the workpiece. In addition, the exit direction of the round stock can thereby be adjusted in narrow ranges.

According to still another form of the device it is provided that the exit die of at least the main arc is pivotable about its vertical axis independently of the base. This, too, is intended for fine adjustment of the arc curvature and for influencing the exit direction of the round stock.

A further form of the device provides that the device for introducing the round stock into at least the dies of the main arc is arranged on a fixed base. This minimizes the cost of construction of the movable parts and a clear separation of the functional groups is obtained.

According to another form of the device it is further provided that the entry die of the series of dies forming at least the main arc is arranged on a fixed base. Thereby a further simplification is achieved, which yet offers all advantages of the invention.

Lastly, according to still another form of the device it is provided that the deflection die of the main arc is also arranged on the fixed base. This combination makes it possible in a simple manner to retrofit existing straightening machines at low cost in such a way that the method of the invention can be carried out.

The invention will now be explained more specifically with reference to the annexed drawings, which show an embodiment.

Figure 2:
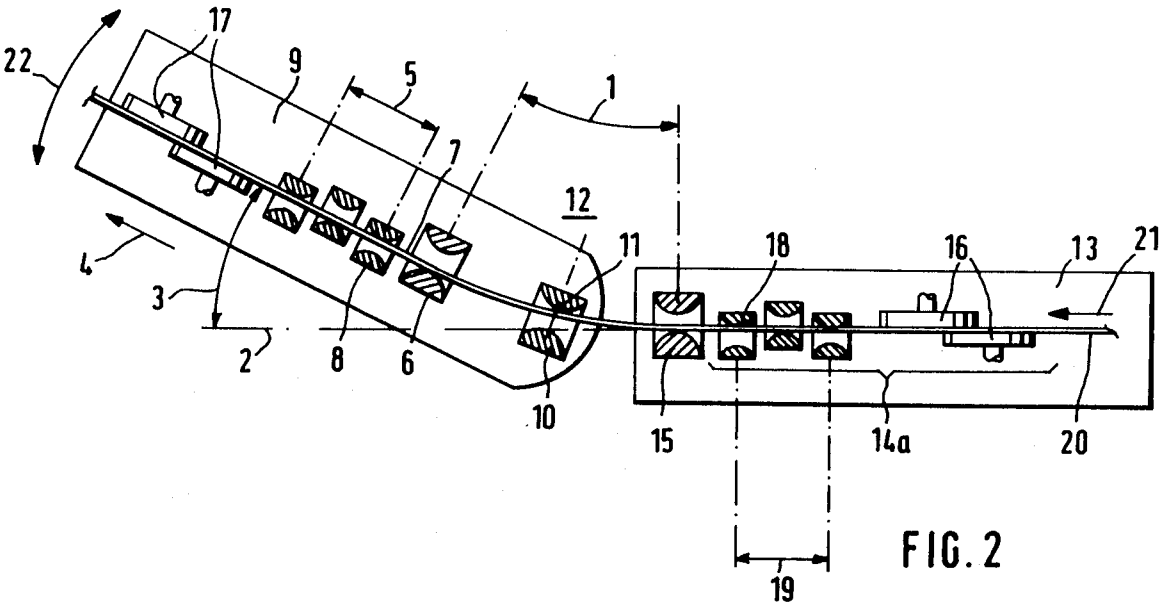

FIG. 1 shows a basic representation of the apparatus of the invention in plan with horizontal section through the dies;

FIG. 2, a representation similar to FIG. 1, but with a pre-straightening series of dies arranged in advance of the main arc forming dies to augment the straightening of short curvatures.

On a fixed base 13 there is arranged, in straightening machines of the kind in question, in the usual known manner, a drivable friction wheel pair 16, which provides for the simultaneous axial and rotational movement of the round stock 20 to be straightened. The round stock 20 is moved forward in the direction of arrow 21. Arrow 21 thus indicates the transport direction of the round stock 20.

When the round stock 20 leaves the friction wheel pair in transport direction, it is received by a straightening die 18 (FIG. 1) and inserted ("threaded") into the entrance die 15 of the main straightener arc 1. Die 15 is arranged fixed on the fixed base 13. In the arrangement described, die 18 fulfills the function of reliably introducing the round stock 20 into the entrance die 15 of straightening arc 1. In this connection it is perfectly possible to arrange the straightening die 18 as an exit die of a preliminary straightening zone 19 (FIG. 2). In this zone 19 the individual dies are set close together and have a relatively small radial offset relative to each other. Straightening zone 19, which may be arranged on the fixed base 13, serves only for the straightening of small, short-ripple curvatures ("nonstraightnesses"). Here the relative arrangement of zone 19 to the friction wheel pair 16 may be in the conventional, manner so that the exit direction is coincident with or at least parallel to the incoming direction. Alternatively it is possible to arrange the elements of arcs following arc or zone 19 in such a way that the exit direction from die 18 is maintained and is taken over by the next die, e.g. the entrance die 15 of arc 1, without constraint. In the embodiment of FIG. 2, the relative arrangement of the straightening zone 19 and friction wheel pair 16 is illustrated in the conventional manner for the sake of simplicity, so that the round stock 20 exit die 18 is at first bent back by die 15 into the entrance direction of arrow 21.

But as the embodiment according to FIG. 1 shows, in principle, prestraightening of the round stock 20 may be omitted altogether.

The assembly 14 (FIG. 1), and 14*a* (FIG. 2) arranged on the fixed base 13 forms in its entirety the device for introducing the round stock 20 into the entrance die 15 of main straightening zone or arc 1. In the embodiment, the entrance die 15 is arranged fixed on the fixed base 13. Arc or zone 1 is the main area in which the round stock 20 is straighened with the desired tolerance. To this end the round stock 20 moving through die 15 in the direction of arrow 21, is taken over by the deflection die 10, which in the embodiment is arranged on the movable base 9, and is guided on into the exit die 6. Exit 6 is also arranged on the movable base 9. In the embodiments, the arrangement of the deflection die 10 and of the exit die 6 on the movable base is such that the round stock 20 abuts on said dies approximately tangentially radial to the innermost portion thereof, as can be seen in FIGS. 1 and 2. While this type of contact between the round stock 20 to be straightened and said dies is especially advantageous, it is not absolutely necessary. To achieve the described advantage, the deflection die 10 must be arranged to be pivotable relative to the movable bars 9 about the vertical axis 11 of the die.

Since in the embodiments the movable base 9 is pivotable in a horizontal arc, as indicated by arrow 22, it suffices if the exit die 6 is not pivotable about its vertical axis relative to the movable base. Due to the ability of the movable base 9 to pivot, the exit die 6 always maintains the desired position.

When the round stock 20 to be straightened leaves the exit die 6 it has undergone a deflection 3 (FIG. 2) from the straight entry line 2 and has now become the straightened round stock 7. So that the undesirable unstraightened end defects described above will not come about, provision must now be made that the round stock 7 leaving die 6 and now straightened can move on in exit direction 4 without being bent back by subsequent dies into the entry direction according to arrow 21 or parallel thereto. In the embodiment, the straightened round stock 7 is taken over for this purpose, without constraint, by the entry die 8 of an additional straightening zone 5 comprising a series of dies arranged on the movable base 9. Behind zone 5 again a drivable friction wheel pair 17 is provided in known manner for onward transport of the straightened round stock 7. Alternatively the straightened round stock 7 may be taken over immediately behind the exit die 6 by the friction wheel pair 17 without interposition of another straightening arc or zone.

However, the interposition of another zone 5 has the advantage that small, short-ripple curvatures can be restraightened. The arrangement may be such that the friction wheel pair 17 is slightly pivoted, so that it receives the round stock 7 coming from zone 5 without a new change of direction. This, then, would be an arrangement according to the invention here at hand. Since the amounts still to be straightened in zone 5 are, as a rule, smaller than the stipulated straightness tolerance of the entire round stock bar to be straightened, such an arrangement is not absolutely necessary. It is perfectly possible to arrange the friction wheel pair 17 so that the round stock coming out of the zone 5 is brought back into the same direction as the round stock 7 entering die 8. The resulting defect of the end is so insignificant that it can be accepted. This is because the main straightening work was performed in straightening arc 1 and the zone 5 is formed so that only very small, short-ripple deviations from straightness are being straightened. In an arrangement according to the embodiments illustrated, therefore, zone 5 in combination with the friction wheel 17 must be regarded in its entirety as a device for receiving the round stock behind main straightening arc or zone 1.

It should be expressly pointed out that the pivotable arrangement of the movable base 9 is not the only possible configuration of a straightening machine for carrying out the straightening method according to the invention. It is perfectly conceivable, for example, to arrange the entire device 14,14*a* and the main straightening arc 1 jointly on a sized machine frame. The dies 6, 10 and 15 defining arc or zone 1 can then be pivotable and radially displaceable in the conventional manner and possibly, in addition, rotatable about the vertical axis. All that is then necessary is to align the devices following main zone 1 in such a way that they can receive the round stock coming out of such zone without deflection. These receiving devices can then either be fixed for a very specific and known case in the necessary receiving position, or they may be pivotable on or with their base or radialy displaceable or both, for adaptation to the necessary exit direction. It does not matter whether the devices which follow main straightening zone 1 are additional mechanisms for the straightening of smaller curvatures or whether they are other devices.

It is, however, conceivable also to provide several straighteners one behind the other in the arrangement according to the invention, so that there results a kind of sine curve of all dies of all successive zone. What is important is only that after exiting from a preceding arc, entry into the next zone occurs without constraint, i.e. with the exit direction being maintained. It is conceivable also to combine such successive zone into one large zone, with which especially long-ripple curvatures can then be straightened.

It will be understood that the various dies referred to are, as is conventional, annular members mounted for rotation about axes parallel to the direction of movement, or in some instances may be set to rotate about axes slightly angularly offset from the direction of movements of the rod being straightened.

The method and apparatus according to the invention permit for the first time a definite improvement of the straightening result at the respective ends of the bars or rods to be straightened.

Having thus described the invention, what is claimed as new and desired to secure by Letters Patent of the United States is:

1. The method of straightening metal round stock comprising the steps of continuously advancing the stock to be straightened while simultaneously rotating said stock about its longitudinal axis, feeding said advancing stock through a first series of spaced apart straightening dies including at least a deflecting die and an exit die the dies of said first series being arrayed to form said stock into an arcuate configuration about a radius of curvature exceeding the yield point of said stock, whereby said stock enters said dies of said series in a first path and leaves said exit die of said first series in a second path diverging from said first path, and introducing said stock leaving said exit die of said first series into a second series of spaced apart straightener dies including an entry die, the dies of said second series being aligned substantially with said second path, whereby said stock enters the dies in said second series without substantial deflection from said second path.

2. Method in accordance with claim 1 and including the step of advancing said stock through a prestraightening series of dies before introducing said stock into the dies of said first series.

3. Apparatus for straightening round metallic stock comprising at least one drive means for simultaneously advancing said stock along a selected path and rotating the same about its longitudinal axis, a first series of spaced apart straightening dies including at least a deflecting die and an exit die, the dies of said first series being arrayed to bend said stock to an arcuate configuration about a radius of curvature exceeding the elastic limit of said rod, the rod emerging from the exit die of said first series along a second path diverging from said selected path, and at least a second series of straightening dies downstream of the exit die of said first series, the dies of said second series including an entrance die substantially aligned with said second path, whereby said stock proceeds from said first to said second series of dies without substantial change of direction.

4. Apparatus in accordance with claim 3 wherein at least one of the dies of said first series is mounted on a first frame, the dies of said second series being mounted on a second frame movable relative to said first frame in the plane of said arc.

5. Apparatus in accordance with claim 4 wherein at least one die of said first series is mounted on said second frame.

6. Apparatus in accordance with claim 5 wherein said dies of said first series include an entrance die, a deflector die and an exit die.

7. Apparatus in accordance with claim 6 wherein said deflector die of said first series is pivotable about a pivot axis perpendicular to the plane of said arc.

8. Apparatus in accordance with claim 6 wherein the exit die of said first series is pivotable about a pivot axis perpendicular to the plane of said base.

9. Apparatus in accordance with claim 6 wherein the deflector and exit dies of said first series are mounted on said second frame.

10. Apparatus in accordance with claim 6 and including a pre-straightener series of dies mounted on said first frame, the entrance die of said first series being positioned to receive stock emerging from said pre-straightener series without substantial deflection.

11. Method of straightening metal round stock comprising the steps of continuously advancing the stock to be straightened while simultaneously rotating said stock about its longitudinal axis, feeding said advancing stock through a first series of spaced apart straightening dies including at least a deflecting die and an exit die the dies of said first series being arrayed to form said stock into an arcuate configuration about a radius of curvature exceeding the yield point of said stock, whereby said stock enters said dies of said series in a first path and leaves said exit die of said first series in a second path diverging from said first path, and introducing said stock leaving said exit die of said first series into further straightening devices whereby said stock enters such further devices without substantial deflection from said second path.

12. Apparatus for straightening round metallic stock comprising at least one drive means for simultaneously advancing said stock along a selected path and rotating the same about its longitudinal axis, a first series of spaced apart straightening dies including at least a deflecting die and an ex.. die, the dies of said first series being arrayed to bend said stock to an arcuate configuration about a radius of curvature exceeding the elastic limit of said rod, the rod emerging from the exit die of said first series along a second path diverging from said selected path, and an assembly to take over the rod downstream of the exit die of said first series, the said assembly including entrance means substantially aligned with said second path, whereby said stock proceeds from said first series of dies to said entrance means without substantial change of direction.

* * * * *